US006517269B1

(12) United States Patent
Scholz et al.

(10) Patent No.: US 6,517,269 B1
(45) Date of Patent: Feb. 11, 2003

(54) NARROW-WIDTH MODULAR PRINTING MECHANISM

(75) Inventors: Marcus Scholz, San Diego, CA (US); Steven R Card, San Diego, CA (US); Shane J. O'Neill, Kildare (IE); Daniel S. Kline, Encinitas, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 63 days.

(21) Appl. No.: 09/696,481

(22) Filed: Oct. 24, 2000

(51) Int. Cl.[7] ..... B41J 2/165

(52) U.S. Cl. ..... 400/656; 347/29; 347/32; 347/33

(58) Field of Search ..... 400/648, 656, 400/657, 658; 347/22, 23, 29, 32, 33, 34, 36

(56) References Cited

U.S. PATENT DOCUMENTS

| | | | | |
|---|---|---|---|---|
| 4,401,990 A | | 8/1983 | Aiba et al. | |
| 5,051,761 A | | 9/1991 | Fisher et al. | |
| 5,094,554 A | | 3/1992 | Hurd et al. | |
| 5,117,244 A | | 5/1992 | Yu | |
| 5,239,316 A | | 8/1993 | Demarchi et al. | |
| 5,250,962 A | | 10/1993 | Fisher et al. | |
| 5,432,539 A | | 7/1995 | Anderson | |
| 5,471,230 A | | 11/1995 | Saito et al. | |
| 5,563,638 A | | 10/1996 | Osborne | |
| 5,585,826 A | | 12/1996 | Schroeder et al. | |
| 5,610,640 A | | 3/1997 | Anderson et al. | |
| 5,627,571 A | | 5/1997 | Andeson et al. | |
| 5,757,398 A | * | 5/1998 | Anderson | 347/30 |
| 5,778,347 A | | 7/1998 | Hetzer | |
| 5,806,994 A | | 9/1998 | Coffy et al. | |
| 5,870,116 A | | 2/1999 | Kyoshima | |
| 5,905,513 A | | 5/1999 | Brandon et al. | |
| 6,172,691 B1 | * | 1/2001 | Belon et al. | 347/104 |
| 6,270,183 B1 | * | 8/2001 | Gaarder | 347/29 |
| 6,328,492 B1 | * | 12/2001 | McKay et al. | 347/29 |

OTHER PUBLICATIONS

Photograph of service station of Brother Mobile Color Inkjet MP–21C/CDX which was on sale in 1999.

* cited by examiner

*Primary Examiner*—Andrew H. Hirshfeld
*Assistant Examiner*—Kevin D. Williams

(57) ABSTRACT

A narrow-width modular printing mechanism for a printer includes an integrated platen/service station assembly positioned within the printer. The integrated platen/service station assembly includes a platen member and a service station mechanically coupled together. The service station includes a bottom portion, at least one cap, at least one wiper and a mechanism for displacing the caps and the wipers relative to the bottom portion. The platen member is formed with apertures which are positioned and sized to facilitate displacement of the caps and the wipers through the platen member. In a preferred embodiment, the integrated platen/service station assembly is configured to accommodate a front-in, front-out paper path of the printer. In a preferred embodiment, the platen/service station assembly includes an actuator fork assembly. In a preferred embodiment, the platen/service station assembly includes a self-aligning cap sled.

21 Claims, 7 Drawing Sheets

NARROW-WIDTH MODULAR PRINTING MECHANISM

CROSS-REFERENCE TO RELATED APPLICATION

This application is related to application Ser. No. 09/115,153 entitled PRINTHEAD SERVICING TECHNIQUE, filed in the name of Glenn Gaarder on Jul. 14, 1998, now U.S. Pat. No. 6,270,183, issued on Aug. 7, 2001. This patent application is assigned to the same assignee as the related application, said related application being incorporated herein by reference.

BACKGROUND OF THE INVENTION

1. Field of Invention

The present invention relates generally to narrow-width modular printing mechanism and, more specifically, to self-contained module including a print bar, paper drive, platen and service station suitable for use as a drop-in module for a printing device.

2. Description of the Related Art

Conventional inkjet print engines contain three primary components which are generally organized in series. These components are the platen (including the print zone), the spittoon, in which excess print drops are disposed, and the service station where cartridge wiping and capping functions occur.

In a conventional inkjet print engine, there may be two or more ink cartridges, or printheads, mounted side-by-side on a traversing carriage which moves substantially perpendicular to the path of the media, e.g. sheets of paper, which pass through the machine to be printed upon. Caps are used to prevent the cartridges from drying out during periods of non-use and they are spaced at a center-to-center distance of the cartridges, as the cartridges are mounted in the carriage, so that each cartridge can be simultaneously capped during periods of inactivity.

Wipers for cleaning the cartridge nozzles during servicing are often mounted on the same center-to-center distance of the cartridges mounted in the carriage. This allows the wipers to move in synchrony while simultaneously wiping the cartridges. This feature renders the wipers capable of being actuated by a common mechanism.

The spittoon can be one common receptacle for receipt of excess ink drops from the cartridges, although in some cases incompatibilities between inks has resulted in the use of separate spittoons.

In conventional inkjet printers, the three above-described components are disposed linearly with a consequent unwanted increase in the width of the finished inkjet engine. In recognition of the problem presented by a wide system, an attempt at optimization, such as staggering the wipers between the caps, has been made. Even here, however, the width of the inkjet printer is the sum of service station width (comprised of capping width, plus one wiper, since the other wiper is disposed between the two caps), plus the platen (having a width at least equal to the width of the media to be printed upon), plus the width of the spittoon(s).

A printing module of reduced size would allow integrators to produce a printing mechanism with a smaller overall size and footprint which is generally viewed as desirable, particularly for marketing to potential purchasers who have limited desktop and/or vertical space. Other potential advantages of a narrower print engine include shorter carriage travel over a shorter slider rod, lower product weight and lower cost.

While the following detailed description relates to inkjet printers, it will be recognized that the principles set forth apply also to small footprint devices in general, such as copiers, fax machines, scanners and combinations thereof

SUMMARY OF THE INVENTION

According to the present invention, a narrow-width modular printing mechanism is provided which is substantially reduced in width compared to conventional 2-pen print mechanisms utilizing TIJ2.0 printing technology (typically range from 400 mm to 430 mm in width) for systems with equivalent functionality. For the narrow-width modular printing mechanism of the present invention, height and depth dimensions have also been substantially reduced.

A narrow-width modular printing mechanism for a printer in accordance with one embodiment of the present invention includes: an integrated platen/service station assembly positioned within the printer, the integrated platen/service station assembly including a platen member and a service station mechanically coupled together, the service station including a bottom portion, at least one cap, at least one wiper and a mechanism for displacing the caps and the wipers relative to the bottom portion, the platen member being formed with a plurality of apertures which are positioned and sized to facilitate displacement of the caps and the wipers through the platen member, the integrated platen/service station assembly being configured to accommodate a front-in, front-out paper path of the printer.

A narrow-width modular printing mechanism for a printer in accordance with another embodiment of the present invention includes: a bottom portion, a cap sled assembly with at least one cap, a wiper sled assembly with at least one wiper, and an actuator fork assembly with a cap sled fork and a wiper sled fork, the cap sled fork being mechanically coupled to the cap sled assembly, the wiper sled fork being mechanically coupled to the wiper sled assembly, the actuator fork assembly being adapted to displace the cap sled assembly and the wiper sled assembly relative to the bottom portion; and a platen formed with a plurality of apertures which are positioned and sized to facilitate displacement of the at least one cap and the at least one wiper through the platen. In a preferred embodiment, the actuator fork assembly includes an actuator shaft and a mechanism for rotating the actuator shaft. In a preferred embodiment, the rotating mechanism includes a cam follower which is secured to the actuator shaft.

A narrow-width modular printing mechanism for a printer in accordance with another embodiment of the present invention includes: a platen/service station assembly including a platen member and a service station secured below the platen member, the service station including a self-aligning cap sled with a plurality of alignment guide members and at least one cap, the platen member being formed with a plurality of apertures which are positioned and sized to facilitate displacement of the alignment guide members and the at least one cap through the platen member. In a preferred embodiment, the plurality of alignment guide members include at least three alignment guide members. In a preferred embodiment, the plurality of alignment guide members are positioned in a nonlinear arrangement across the self-aligning cap sled.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

Figure 1:
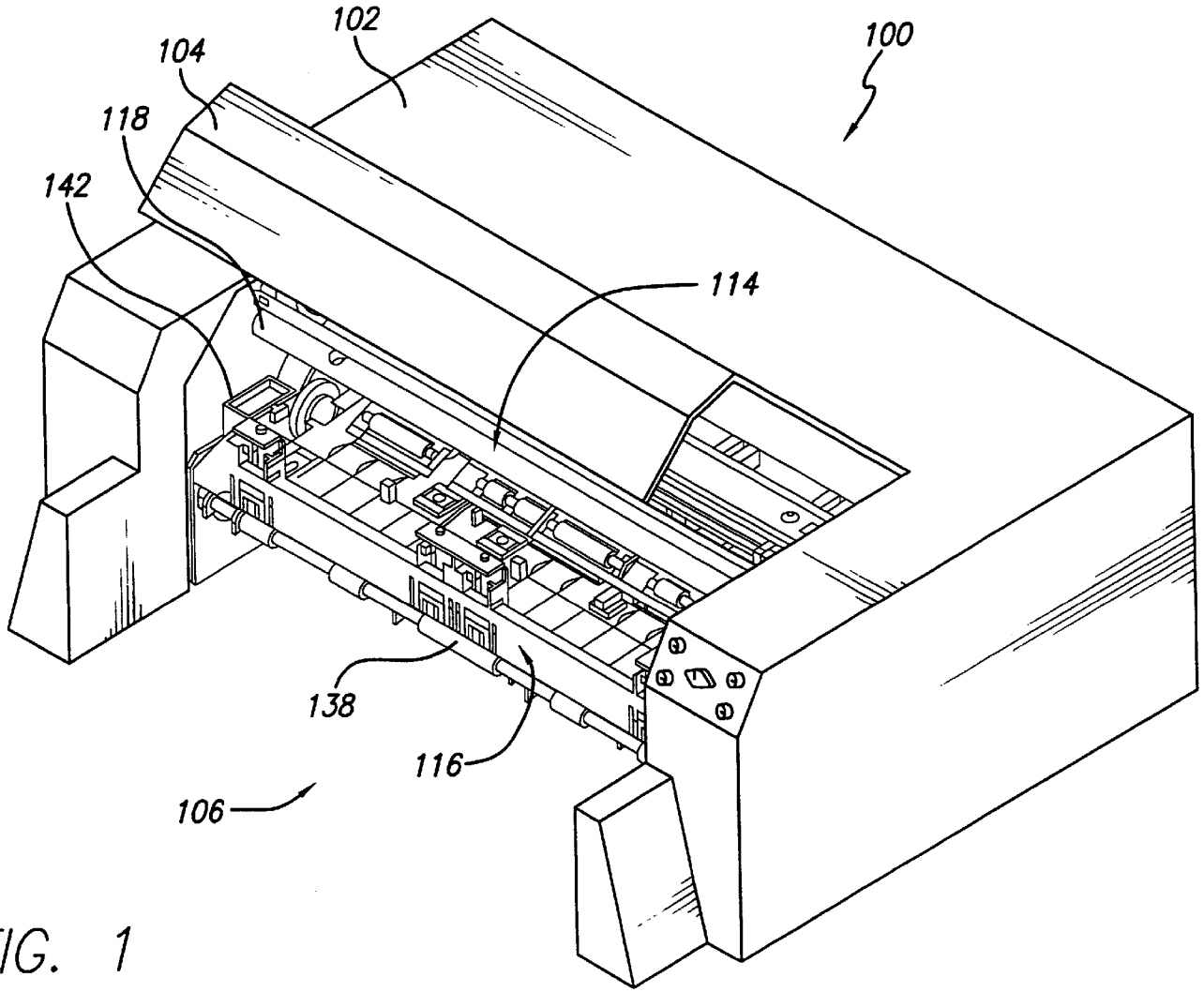
FIG. 1 is an isometric view of a printer configured to employ the principles of the present invention.

FIG. 1 shows a printer 100, e.g., an inkjet printer, configured to employ the principles of the present invention. The illustrated exemplary preferred printer 100 includes a main housing 102 and a front panel 104 through which a printing mechanism 106 is accessible.

Figure 2:
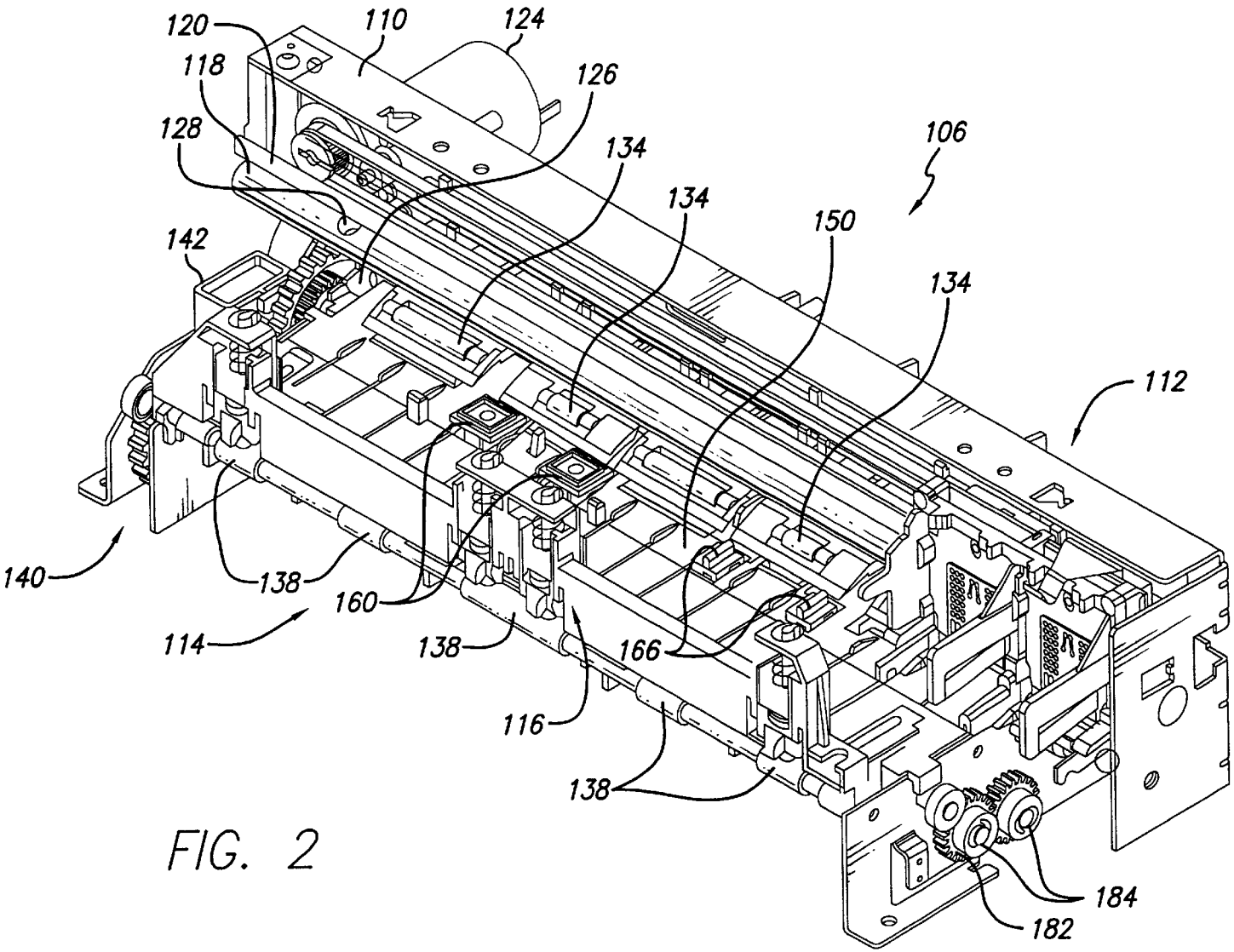
FIG. 2 is an isometric view of an exemplary preferred narrow-width modular printing mechanism according to the present invention.

Referring to FIG. 2, the illustrated exemplary preferred printing mechanism 106 includes a chassis 110, a carriage assembly 112, an integrated platen/service station assembly 114 and an output star wheel assembly 116 configured as shown. The printing mechanism 106 also includes a slider bar 118, an encoder strip 120, a Z-height adjuster 122 (FIGS. 3 and 4) and a carriage or scan axis motor 124. In a preferred embodiment, the slider bar 118 is cross-drilled through the side of the shaft for securing the slider bar 118 directly to platen mounting side plates 126 which are part of the chassis 110. For example, two drill holes 128 are formed in the slider bar 118 approximately two inches from either end of the slider bar 118 for securing the slider bar 118 to corresponding platen mounting side plates 126. A potential advantage of cross-drilling the slider bar 118 is the elimination of the need for outboard features or parts to support the slider bar 118 at its ends. The elimination of outboard mounts provides for a reduction in the width of the printing mechanism 106.

Figure 4:
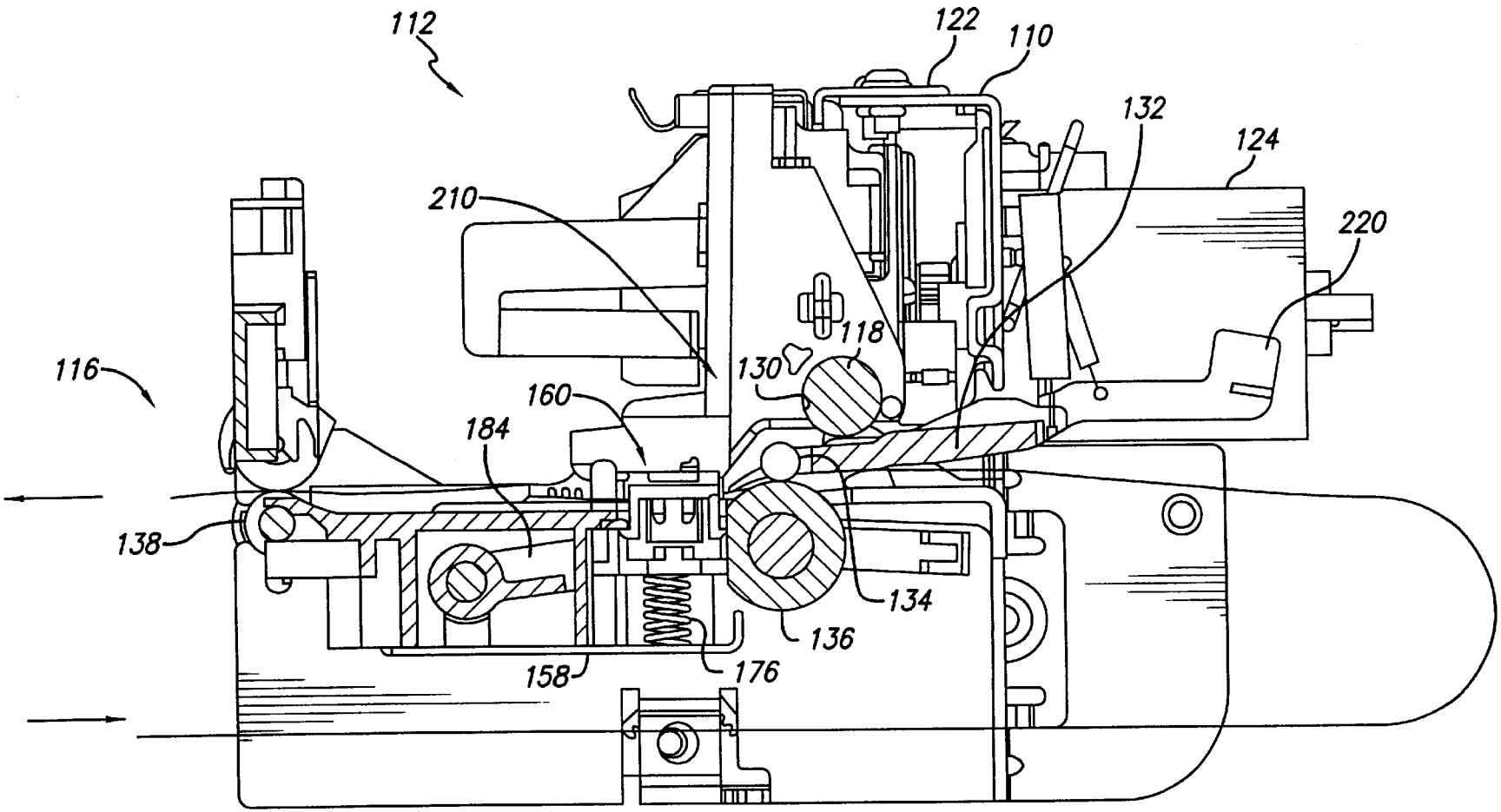
FIG. 4 is a cross-sectional view of the printing mechanism of FIG. 3 along line 4—4.

Referring to FIG. 4, the carriage assembly 112 includes C-shaped bearings 130 to accommodate the intermediate mounting points along the slider bar 118. In operation, it has been observed that the C-shaped bearings 130 contact the slider bar 118 in two discrete locations. By designing the bearings 130 so that the points where they contact the slider bar 118 are known, it provides a distinct advantage in assuring that the carriage assembly 112 is stable with respect to the slider bar 118 and does not lift off during acceleration. Also, the C-shaped bearings 130 provide the advantage of allowing the slider bar 118 to be positioned closer to the pinch roller arms 132, which reduces the overall height of the printing mechanism 106.

Figure 3:
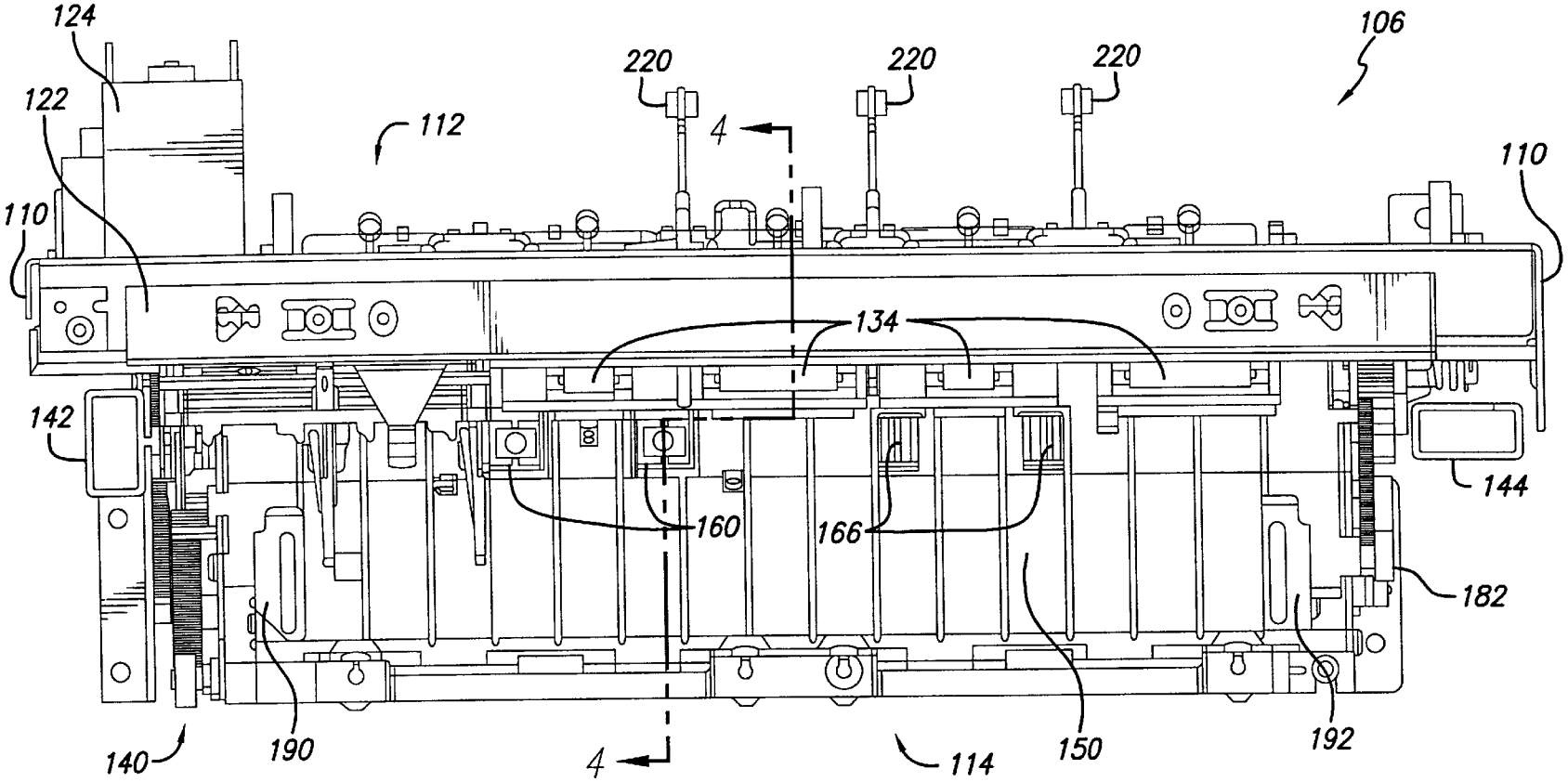
FIG. 3 is a top view of the printing mechanism of FIG. 2.

Referring to FIGS. 3 and 4, the illustrated exemplary Z-height adjuster 122 comprises a L-shaped (stainless steel) member which is used to adjust the distance between the nozzle plate and the media. In operation, a rotational stop on the carriage assembly 112 contacts a rail of the Z-height adjuster 122 which is adjusted to produce a rotation of the carriage assembly 112 relative to the slider bar 118 as the carriage assembly 112 scans along the slider bar 118. It should be appreciated, however, that other mechanisms can be employed for adjusting the pin-to-paper spacing.

Referring to FIGS. 1 and 4, the illustrated exemplary preferred printing mechanism 106 also includes a plurality of pinch rollers 134 and a drive roller 136 which are configured as shown to advance sheets of media along the paper path and over the print zone. At the front end of the print mechanism 106, the output star wheel assembly 116 and a kickout or output roller 138 are configured as shown to advance printed sheets of media out of the printer 100. The illustrated exemplary preferred printing mechanism 106 also includes drive roller and star roller drive gears 140 which are engaged with a paper axis motor (not shown). Referring to FIG. 3, the illustrated exemplary preferred printing mechanism 106 also includes spittoons 142, 144 positioned as shown on opposite ends of the platen/service station assembly 114.

Figure 5:
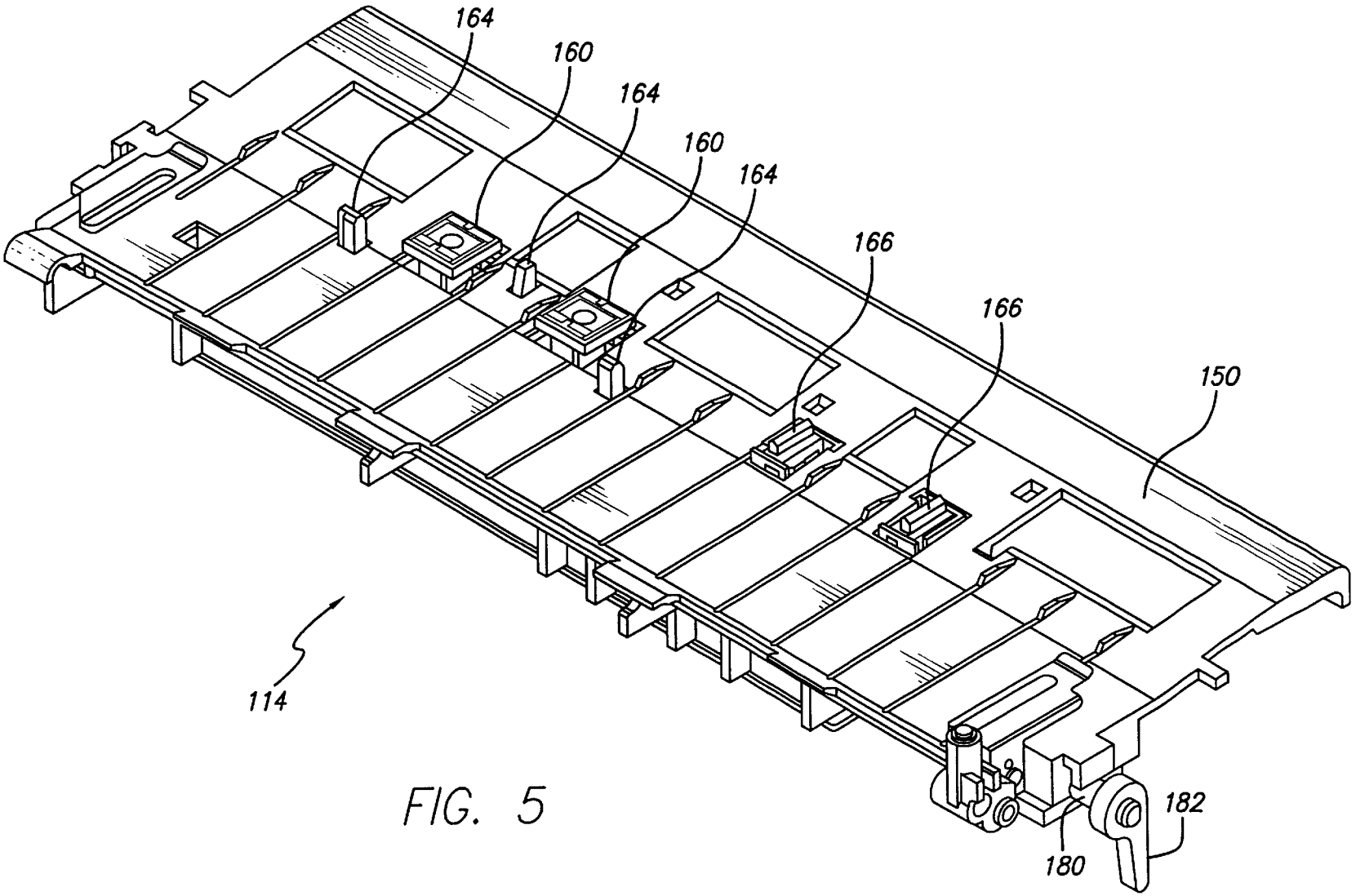
FIG. 5 is an isometric view of a platen/service station assembly of the printing mechanism of FIG. 2.
Figure 6:
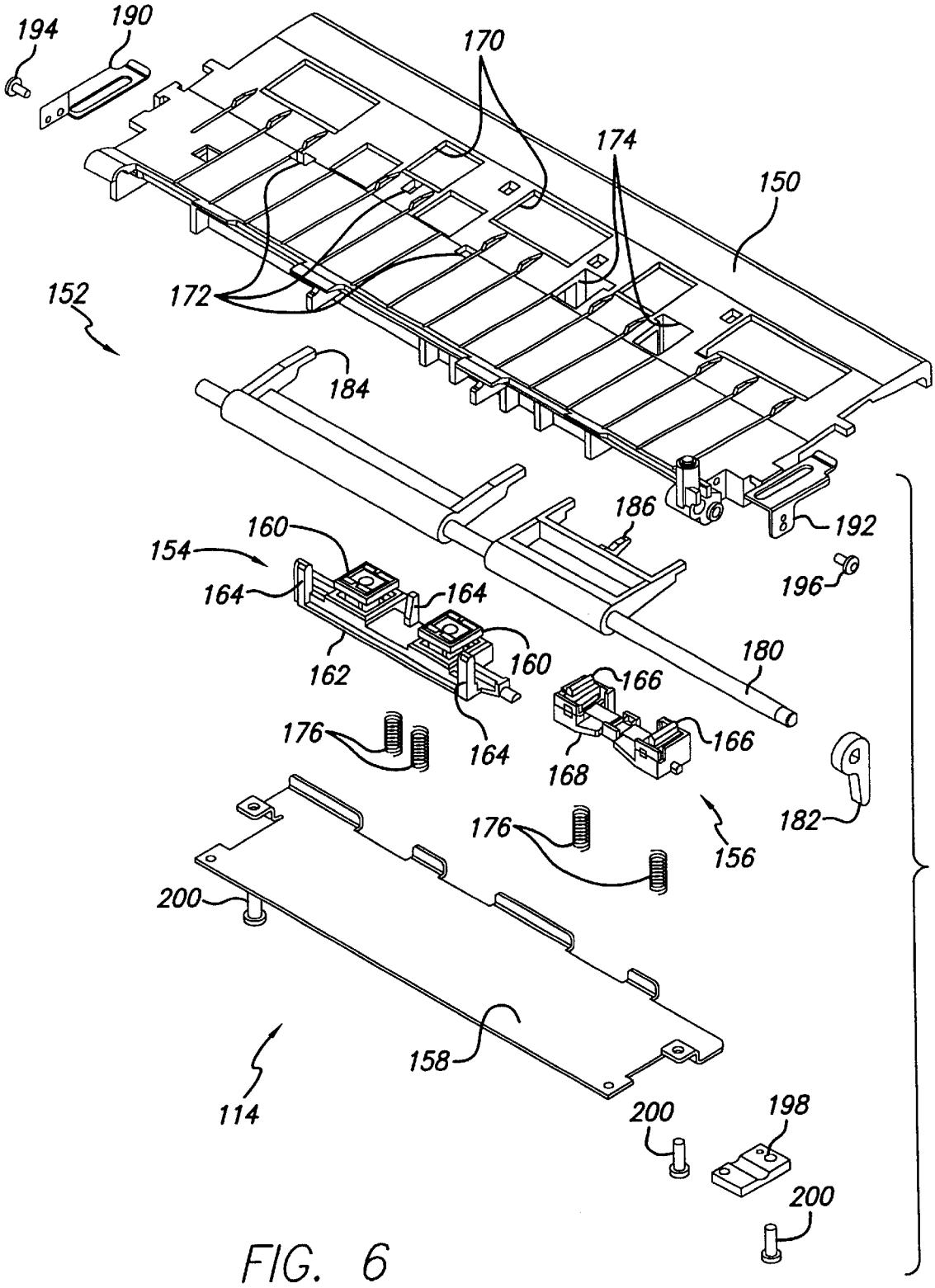
FIG. 6 is an exploded isometric view of the platen/service station assembly of FIG. 5.

Referring to FIGS. 5 and 6, the platen/service station assembly 114 is shown in greater detail. The illustrated exemplary preferred platen/service station assembly 114 includes a platen member 150, an actuator fork assembly 152, a "self aligning" cap sled assembly 154, a wiper sled assembly 156 and a bottom portion (cover bottom) 158 formed and assembled as shown. The cap sled assembly 154 includes at least one cap 160, a cap sled base portion 162 and a plurality of alignment guide members (alignment posts) 164. In a preferred embodiment, two caps 160 are mechanically coupled to the cap sled base portion 162 and at least three alignment guide members 164 are positioned in a nonlinear arrangement across the cap sled base portion 162 as shown. The wiper sled assembly 156 includes at least one wiper 166 and a wiper sled base portion 168. In a preferred embodiment, two wipers 166 are mechanically coupled to the wiper sled base portion 168 as shown.

In the illustrated exemplary preferred embodiment, the platen member 150 is formed with a plurality of apertures 170, 172, 174 which are positioned and sized to facilitate displacement of the caps 160, the alignment guide members 164 and the wipers 166, respectively, through the platen member 150.

Thus, the caps 160, wipers 166 and associated service station mechanics are moved into the platen area; and the platen member 150 functions as the "service station chassis" and provides the vertical guide features for the Z-translation of the cap sled and the wiper stems. The wipers 166 are separated from the caps 160 in the scan direction so that wiping and capping take place in separate locations that do not overlap. The caps 160 and wipers 166 are biased upward by springs 176 that react against the bottom cover 158 which is attached to the platen member 150 from underneath.

Figure 7:
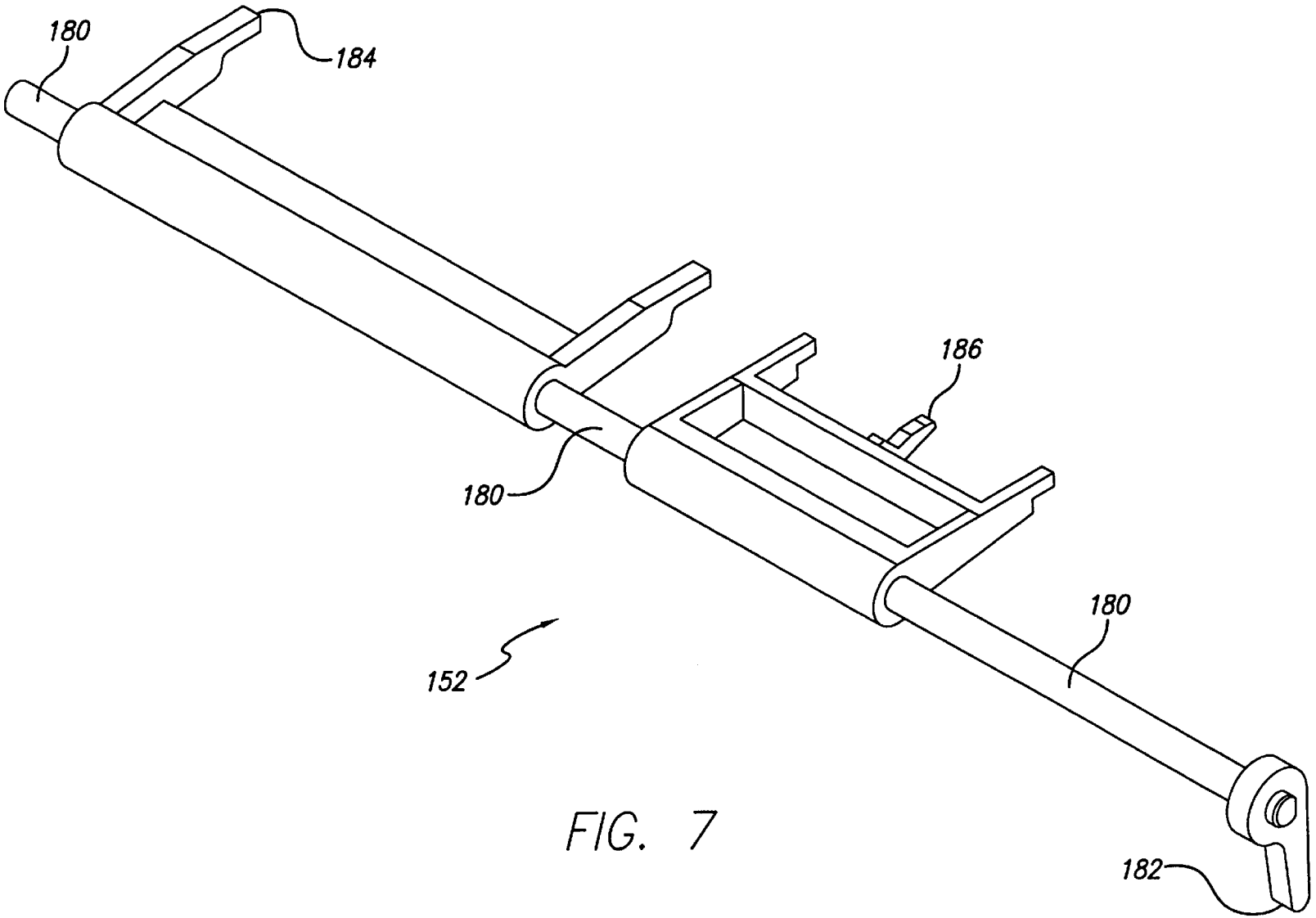
FIG. 7 is an enlarged isometric view of an actuator fork assembly of the platen/service station assembly of FIG. 5.

Referring to FIG. 7, the actuator fork assembly 152 is shown in greater detail. Generally, the actuator fork assembly 152 functions as a mechanism for displacing the caps 160 and the wipers 166 relative to the bottom portion 158. Preferably, the actuator fork assembly 152 is mechanically coupled to the caps 160 and the wipers 166 and configured to simultaneously displace the caps 160 and wipers 166. In the illustrated exemplary preferred embodiment, the actuator fork assembly 152 includes an actuator shaft (rocker arm shaft) 180 and a mechanism for rotating the actuator shaft 180 in the form of a cam follower 182 which is secured to the actuator shaft 180. The actuator fork assembly 152 also includes a cap sled fork 184 and a wiper sled fork 186. The cap sled fork 184 is secured to and about the actuator shaft 180 and mechanically coupled to the cap sled assembly 154. Similarly, the wiper sled fork 186 is secured to and about the actuator shaft 180 and mechanically coupled to the wiper sled assembly 156. Thus, the actuator fork assembly 152 is adapted to displace the cap sled assembly 154 and the wiper sled assembly 156 relative to the bottom portion 158. Referring to FIG. 2, cam gears 184 are shown operatively engaged with the cam follower 182.

Referring again to FIG. 6, the illustrated exemplary preferred platen/service station assembly 114 also includes a left media guide 190, a right media guide 192 and fasteners 194, 196 for securing the left media guide 190 and the right media guide 192, respectively, to the platen member 150. The illustrated exemplary preferred platen/service station assembly 114 additionally includes an actuator shaft bearing 198 and fasteners 200 as shown.

In operation, the rocker-arm shaft 180 permits the caps 160 and the wipers 166 to rise simultaneously when it is rotated counterclockwise. A cam, driven by the paper axis drive motor, contacts the cam follower 182 causing the rocker-arm shaft 180 to rotate. When the rocker-arm shaft 180 is rotated in the opposite direction, the caps 160 and the wipers 166 are forced downward so that they are recessed below the platen member 150. The three alignment posts 164 of the cap sled assembly 154 engage the carriage assembly 112 to ensure proper X-Y alignment. Capping and wiping forces are both controlled by the compression springs 176.

Moving the capping and wiping functions from the side of the print area into the middle of the print area has a number of effects. The platen 150 becomes an integral part of the print bar assembly, which leads to the integration of the drive roller and pinch roller assemblies. Capping and wiping cannot take place during printing as the media covers up the caps and wipers. Therefore, pen service algorithms that require wiping during a print are excluded.

Separating the caps 160 and the wipers 166 is possible once they are moved into the print area due to the increased width available. The capping and wiping functions become independent. In DeskJet style service stations, the capping and wiping functions overlap due to the fact that both mechanisms are mounted to the sled, and are close together in the scan direction. As the wipers do not get in the way when trying to cap, the design of the carriage is simplified and the engagement of the locating features on the cap sled with the carriage is simplified. The Z-travel of the cap sled is reduced from DeskJet based designs. Moreover, there is plenty of room for bi-directional wiping. The ability to spatially separate the capping and wiping mechanisms from each other is a significant design advantage.

If the caps 160 and the wipers 166 are sufficiently close to the drive roller 136 (as with the illustrated embodiment), then the drive roller 136 is segmented such that the caps 160 and the wipers 166 interleave the roller segments. As a result, some of the ribbing in the platen member 150 is interrupted. Also, the rib spacing of the exemplary illustrated platen member 150 is slightly irregular to provide room for the caps 160 and the wipers 166.

Referring to FIG. 3, the illustrated carriage assembly 112 includes two stalls sized to receive ink cartridges. In a preferred embodiment, the ink cartridges (not shown) are held in place by a low stress latch spring design, and a "keyed carriage structure" is employed to prevent the wrong ink cartridge from being inserted into a particular stall. The illustrated carriage assembly 112 also includes a sub-sled 210 (FIG. 4) which functions to transmit belt drive forces to the carriage assembly 112, preferably near the center of gravity of the carriage assembly 112.

In a preferred embodiment, the printing mechanism 106 also includes a plurality of flag members 220 which are positioned to provide indications of the size of media and whether media has been fed correctly. These flag sensors (or any other type of sensor for that matter) can be employed to control printing operations to prevent the ink cartridges from spraying ink on exposed caps and wipers.

In a preferred embodiment, the pen center-to-center distance is moved closer together, for example, reduced to 32 mm from the historical 34.88 mm—thus saving 5.76 mm overall width.

In a preferred embodiment, any unnecessary carriage structure on the right and left sides of the pen bodies is reduced. For example, the walls that support the carriage bearing areas are recessed so that features on the ends of the chassis can extend into this area without adding to the overall width of the printing mechanism 106.

In a preferred embodiment, a center-biased print zone is employed—center justifying the media, e.g., via rack and pinion, so that the A4 media print zone is contained within the U.S. letter print zone.

Another feature of the present invention, is that it allows for printing during the acceleration ramp.

Conventionally, the carriage is required to reach slew velocity, or very near slew velocity, prior to firing the first dot in order to avoid print quality issues. The acceleration ramp distance then defines a minimum over-travel distance on either side of the print region.

Usually, in a DeskJet-based architecture, the service station is outboard of the print area. One of the byproducts of this decision is that the carriage travel necessary to get the pens into the capping and wiping positions is more than the required acceleration ramp distance. Typically, the paper motor drive is located on the opposite side of the platen area, and the width of the paper motor drive assembly or the acceleration ramp drives the width of the print mechanism on that side.

According to the present invention, by moving the service station into the platen area it is possible to take advantage of printing during acceleration on what used to be the service station side of the machine. Also, by designing the paper motor drive within the footprint of the carriage at the turnaround point, printing during acceleration can be taken advantage of on the paper motor side of the mechanism.

In a preferred embodiment of the present invention, printing is allowed while the carriage assembly 112 is still accelerating from zero velocity at the turn-around position to slew velocity, and when the carriage assembly 112 is decelerating from slew velocity to zero. As a result, the turn-around positions can be moved inward toward the print zone thereby reducing the overall width of the print mechanism 106.

Although the present invention has been described in terms of the preferred embodiment above, numerous modifications and/or additions to the above-described preferred embodiment would be readily apparent to one skilled in the art. For example, the principles of the present invention are also applicable to a device employing a L-shaped paper path. It is intended that the scope of the present invention extends to all such modifications and/or additions.

We claim:

1. A narrow-width modular printing mechanism for a printer, comprising:

an integrated platen/service station assembly positioned within the printer, the integrated platen/service station assembly including a platen member and a service station mechanically coupled together, the service station including a bottom portion, at least one cap, at least one wiper, a mechanism for displacing the caps and the wipers relative to the bottom portion, and at least one spring positioned between the caps and the bottom portion, the platen member being formed with a plurality of apertures which are positioned and sized to facilitate displacement of the caps and the wipers through the platen member, the integrated platen/service station assembly being configured to accommodate a front-in, front-out paper path of the printer.

2. The narrow-width modular printing mechanism for a printer of claim 1, wherein the bottom portion includes a bottom plate.

3. The narrow-width modular printing mechanism for a printer of claim 1, wherein the at least one cap includes two caps.

4. The narrow-width modular printing mechanism for a printer of claim 1, wherein the at least one wiper includes two wipers.

5. The narrow-width modular printing mechanism for a printer of claim 1, wherein the displacing mechanism is mechanically coupled to the caps.

6. The narrow-width modular printing mechanism for a printer of claim 1, wherein the displacing mechanism is mechanically coupled to the wipers.

7. The narrow-width modular printing mechanism for a printer of claim 1, wherein the displacing mechanism includes a fork assembly.

8. A narrow-width modular printing mechanism for a printer, comprising:

an integrated platen/service station assembly positioned within the printer, the integrated platen/service station assembly including a platen member and a service station mechanically coupled together, the service station including a bottom portion, at least one cap, at least one wiper, a mechanism for displacing the caps and the wipers relative to the bottom portion, and at least one spring positioned between the wipers and the bottom portion, the platen member being formed with a plurality of apertures which are positioned and sized to facilitate displacement of the caps and the wipers through the platen member, the integrated platen/service station assembly being configured to accommodate a front-in, front-out paper path of the printer.

9. The narrow-width modular printing mechanism for a printer of claim 8, wherein the bottom portion includes a bottom plate.

10. The narrow-width modular printing mechanism for a printer of claim 8, wherein the at least one cap includes two caps.

11. The narrow-width modular printing mechanism for a printer of claim 8, wherein the at least one wiper includes two wipers.

12. The narrow-width modular printing mechanism for a printer of claim 8, wherein the displacing mechanism is mechanically coupled to the caps.

13. The narrow-width modular printing mechanism for a printer of claim 8, wherein the displacing mechanism is mechanically coupled to the wipers.

14. The narrow-width modular printing mechanism for a printer of claim 8, wherein the displacing mechanism includes a fork assembly.

15. A narrow-width modular printing mechanism for a printer, comprising:

a service station assembly including a bottom portion, a cap sled assembly with at least one cap, a wiper sled assembly with at least one wiper, and an actuator fork assembly with a cap sled fork and a wiper sled fork, the cap sled fork being mechanically coupled to the cap sled assembly, the wiper sled fork being mechanically coupled to the wiper sled assembly, the actuator fork assembly being adapted to displace the cap sled assembly and the wiper sled assembly relative to the bottom portion; and a platen formed with a plurality of apertures which are positioned and sized to facilitate displacement of the at least one cap and the at least one wiper through the platen.

16. The narrow-width modular printing mechanism for a printer of claim 15, wherein the actuator fork assembly includes an actuator shaft and a mechanism for rotating the actuator shaft.

17. The narrow-width modular printing mechanism for a printer of claim 16, wherein the cap sled fork is secured about the actuator shaft.

18. The narrow-width modular printing mechanism for a printer of claim 16, wherein the wiper sled fork is secured about the actuator shaft.

19. A narrow-width modular printing mechanism for a printer, comprising:

a service station assembly including a bottom portion, a cap sled assembly with at least one cap, a wiper sled assembly with at least one wiper, an actuator fork assembly with a cap sled fork and a wiper sled fork, the cap sled fork being mechanically coupled to the cap sled assembly, the wiper sled fork being mechanically coupled to the wiper sled assembly, the actuator fork assembly being adapted to displace the cap sled assembly and the wiper sled assembly relative to the bottom portion, the actuator fork assembly including an actuator shaft and a mechanism for rotating the actuator shaft, the rotating mechanism including a cam follower which is secured to the actuator shaft; and a platen formed with a plurality of apertures which are positioned and sized to facilitate displacement of the at least one cap and the at least one wiper through the platen.

20. A narrow-width modular printing mechanism for a printer, comprising:

a service station assembly including a bottom portion, a cap sled assembly with at least one cap, a wiper sled assembly with at least one wiper, an actuator fork assembly with a cap sled fork and a wiper sled fork, the cap sled fork being mechanically coupled to the cap sled assembly, the wiper sled fork being mechanically coupled to the wiper sled assembly, the actuator fork assembly being adapted to displace the cap sled assembly and the wiper sled assembly relative to the bottom portion, and at least one spring member positioned between the cap sled assembly and the bottom portion; and a platen formed with a plurality of apertures which are positioned and sized to facilitate displacement of the at least one cap and the at least one wiper through the platen.

21. A narrow-width modular printing mechanism for a printer, comprising:

a service station assembly including a bottom portion, a cap sled assembly with at least one cap, a wiper sled assembly with at least one wiper, an actuator fork assembly with a cap sled fork and a wiper sled fork, the cap sled fork being mechanically coupled to the cap sled assembly, the wiper sled fork being mechanically coupled to the wiper sled assembly, the actuator fork assembly being adapted to displace the cap sled assembly and the wiper sled assembly relative to the bottom portion, and at least one spring member positioned between the wiper sled assembly and the bottom portion; and a platen formed with a plurality of apertures which are positioned and sized to facilitate displacement of the at least one cap and the at least one wiper through the platen.

* * * * *